US010190318B2

(12) United States Patent
Iannelli

(10) Patent No.: US 10,190,318 B2
(45) Date of Patent: Jan. 29, 2019

(54) GUTTER AND BRACKET ASSEMBLY

(71) Applicant: Anthony M. Iannelli, Cincinnati, OH (US)

(72) Inventor: Anthony M. Iannelli, Cincinnati, OH (US)

( * ) Notice: Subject to any disclaimer, the term of this patent is extended or adjusted under 35 U.S.C. 154(b) by 0 days.

(21) Appl. No.: 15/609,934

(22) Filed: May 31, 2017

(65) Prior Publication Data

US 2017/0350129 A1 Dec. 7, 2017

Related U.S. Application Data

(60) Provisional application No. 62/345,127, filed on Jun. 3, 2016.

(51) Int. Cl.

| | |
|---|---|
| ***E04D 13/072*** | (2006.01) |
| ***E04D 13/064*** | (2006.01) |
| ***E04D 13/076*** | (2006.01) |
| *E04D 13/00* | (2006.01) |
| *E05D 5/02* | (2006.01) |

(52) U.S. Cl.

CPC ..... *E04D 13/076* (2013.01); *E04D 13/064* (2013.01); *E04D 13/072* (2013.01); *E04D 13/0725* (2013.01); *E04D 13/00* (2013.01); *E05D 5/02* (2013.01)

(58) Field of Classification Search

CPC . E04D 13/073; E04D 13/072; E04D 13/0725; E04D 13/064; E04D 13/00; E05D 5/02

USPC ..... 52/11, 12, 14; 248/48.1, 48.2

See application file for complete search history.

(56) References Cited

U.S. PATENT DOCUMENTS 124,382 A * 3/1872 Perkins et al. ..... E04D 13/0725 248/48.2
3,296,749 A * 1/1967 Cotter ..... E04D 13/0725 248/48.2
3,913,284 A * 10/1975 Hall ..... E04D 13/0645 405/119
4,043,527 A * 8/1977 Franzmeier ..... E04D 13/0725 219/213
4,632,342 A * 12/1986 Skinner ..... E04D 13/0725 248/48.2
4,745,657 A * 5/1988 Faye ..... E04D 13/076 16/226
5,388,377 A * 2/1995 Faulkner ..... E04D 13/0725 52/11
5,737,879 A * 4/1998 Sweet ..... E04D 13/0725 248/48.1

(Continued)

*Primary Examiner* — Theodore V Adamos
(74) *Attorney, Agent, or Firm* — Frost Brown Todd LLC

(57) ABSTRACT

A gutter bracket assembly comprises a gutter bracket comprising a back portion, an intermediate portion extending frontwardly from the back portion, a first flange extending outwardly from the intermediate portion, and a second flange extending outwardly from the intermediate portion. The gutter bracket assembly further comprises a gutter having a back coupled with the back portion of the gutter bracket, a bottom extending frontwardly from the back, and a front extending upwardly from the bottom, wherein the front comprises a first protrusion and a second protrusion, which form a first and second cavity. The first flange of the gutter bracket engages the second cavity of the gutter and the second flange of the gutter bracket engages the first cavity of the gutter.

5 Claims, 3 Drawing Sheets

(56) References Cited

U.S. PATENT DOCUMENTS

| | | | | |
|---|---|---|---|---|
| 5,845,435 | A * | 12/1998 | Knudson | E04D 13/0725 248/48.1 |
| 6,543,729 | B1 * | 4/2003 | Ylonen | E04D 13/0725 248/48.1 |
| 6,701,674 | B1 * | 3/2004 | Albracht | E04D 13/0725 52/11 |
| 7,861,980 | B1 * | 1/2011 | Verbrugge | E04D 13/0725 248/48.1 |
| 2002/0073631 | A1 * | 6/2002 | Baker | E04D 13/0725 52/12 |
| 2005/0172565 | A1 * | 8/2005 | Riley | E04D 13/076 52/12 |
| 2005/0193638 | A1 * | 9/2005 | Robinson | E04D 13/0725 52/12 |
| 2006/0265968 | A1 * | 11/2006 | Lowrie, III | E04D 13/076 52/11 |
| 2008/0120920 | A1 * | 5/2008 | Knudson | E04D 13/0725 52/12 |
| 2010/0251626 | A1 * | 10/2010 | Roque Alonso | E04D 13/0641 52/12 |
| 2011/0126477 | A1 * | 6/2011 | Hurn | E04D 13/076 52/12 |
| 2016/0060870 | A1 * | 3/2016 | Martin | E04D 13/064 52/12 |

* cited by examiner

GUTTER AND BRACKET ASSEMBLY

CROSS REFERENCE TO RELATED APPLICATIONS

The present application hereby claims the benefit of the provisional patent application of the same title, Ser. No. 62/345,127, filed on Jun. 3, 2016, the disclosure of which is herein incorporated by reference in its entirety.

BACKGROUND

Gutters are typically attached to an edge of a roof or fascia board and include a trough to collect and divert rain water away from the edge of the roof. In some instances, such as during the winter, the trough of the gutter may fill with ice, snow, or other debris. The weight from this debris can cause the front of the gutter to sag or pull away from the edge of the roof. This can damage the gutter or prevent the gutter from being able to collect and divert rain water away from the edge of the roof.

BRIEF SUMMARY

A gutter bracket comprises a back portion, an intermediate portion extending frontwardly from the back portion, a first flange extending outwardly from the intermediate portion, and a second flange extending outwardly from the intermediate portion. The first and second flanges of the gutter bracket are configured to engage with a gutter such that each of the first and second flanges are configured to support the gutter.

A gutter bracket assembly comprises a gutter bracket comprising a back portion, an intermediate portion extending frontwardly from the back portion, a first flange extending outwardly from the intermediate portion, and a second flange extending outwardly from the intermediate portion. The gutter bracket assembly further comprises a gutter having a back coupled with the back portion of the gutter bracket, a bottom extending frontwardly from the back, and a front extending upwardly from the bottom, wherein the front comprises a first protrusion and a second protrusion, which form a first and second cavity. The first flange of the gutter bracket engages the second cavity of the gutter and the second flange of the gutter bracket engages the first cavity of the gutter.

A method for reinforcing a gutter with a gutter bracket. The method comprises the steps of inserting the gutter bracket within a gutter such that the first flange of the gutter bracket engages the second cavity of a gutter, and the second flange of the gutter bracket engages the first cavity of the gutter, and coupling the back portion of the gutter bracket to a back of the gutter.

These and other objects and advantages shall be made apparent from the accompanying drawings and the description thereof.

BRIEF DESCRIPTION OF THE FIGURES

The accompanying drawings, which are incorporated in and constitute a part of this specification, illustrate embodiments, and together with the general description given above, and the detailed description of the embodiments given below, serve to explain the principles of the present disclosure.

DETAILED DESCRIPTION

A gutter (50) includes a long trough or duct that can be attached to the edge of a roof or fascia board. This allows the gutter (50) to collect rainwater from the roof of a building and divert it away from the structure of the building.

Figure 1:
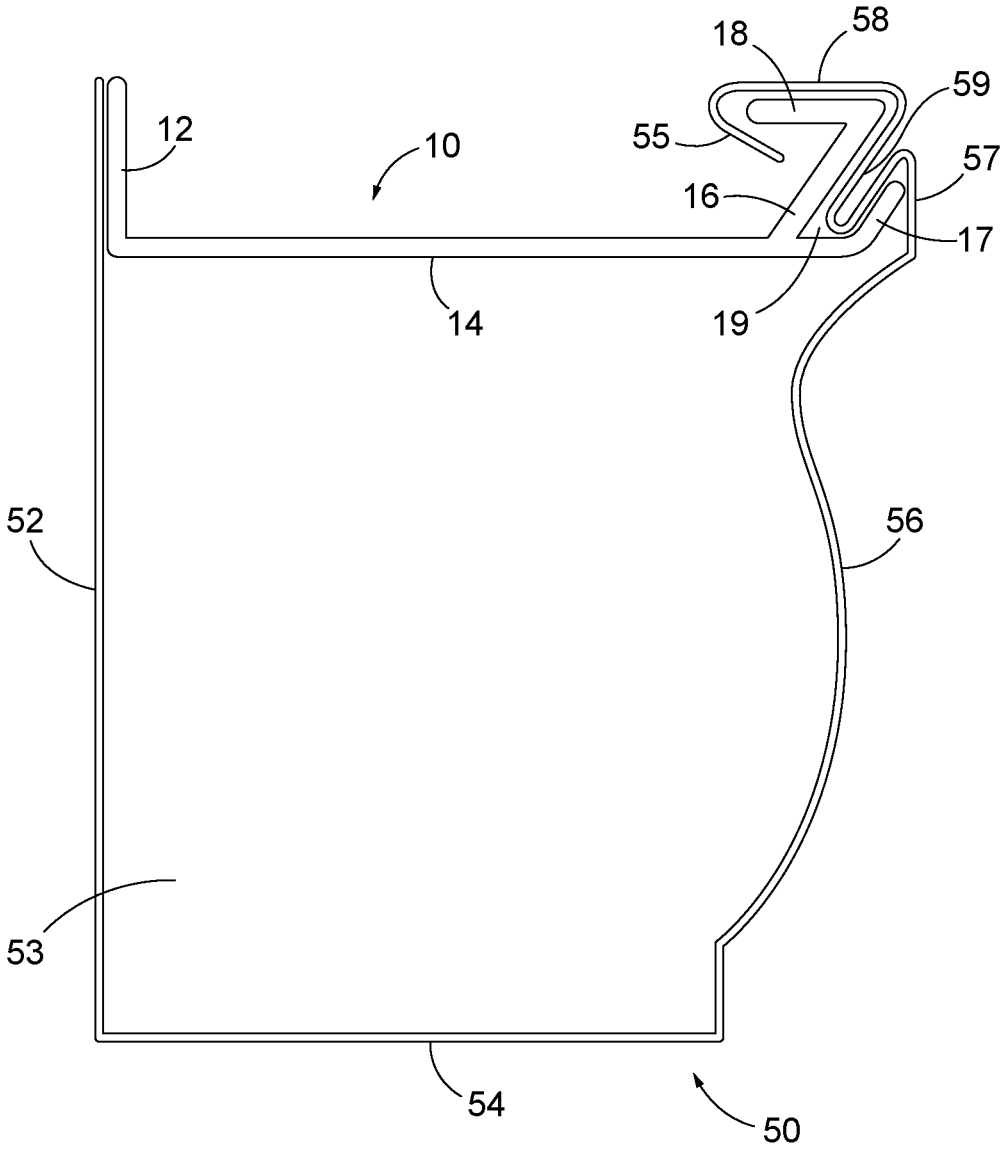
FIG. 1 is a side view of an embodiment of a bracket assembled with a gutter.

FIG. 1 shows a gutter (50) having a back (52), a front (56), and a bottom (54) extending between the back (52) and front (56) to form a trough (53). The back (52) of gutter (50) can be attached to an edge of a roof or a fascia board such that the gutter (50) extends along the bottom of the roof. The trough (53) of the gutter (50) is wide enough to collect and divert rain water away from the edge of the roof. Because of the width of gutter (50), the front (56) of gutter (50) may sag or pull away from the back (52) of gutter (50). Therefore, it may be desirable to provide a gutter bracket (10) that can be used to reinforce the gutter (50) to reduce or prevent the front (56) of the gutter (50) from sagging or releasing from the gutter bracket. FIG. 1 further shows an embodiment of a gutter bracket (10) including a back portion (12), an intermediate portion (14), and flanges (16, 17). The back portion (12) is substantially vertical and is couplable with the back (52) of the gutter (50). The back portion (12) may be coupled with the back (52) of the gutter (50) by a nail, a screw, a bolt, adhesive, or other suitable types of fasteners. The back portion (12) and/or the back (52) of the gutter (50) may further be coupled with the edge of a roof or a fascia board (not shown).

The intermediate portion (14) of the gutter bracket (10) then extends frontwardly from the back portion (12) of the gutter bracket (10), as shown in FIG. 1. In the illustrated embodiment, the intermediate portion (14) is substantially horizontal and is of sufficient length to extend from the back (52) of the gutter (50) to the front (56) of the gutter (50), such that the intermediate portion (14) has a similar length as the bottom (54) of the gutter (50). Flanges (16, 17) then extend from the opposing end of the intermediate portion (14) on a front portion of the gutter bracket (10). The first flange (16) extends obliquely away from the intermediate portion (14) and in some embodiments comprises a lip (18) extending from the first flange (16) toward the back portion (12) of the gutter bracket (10). FIG. 1 shows the lip (18) as substantially parallel with the intermediate portion (14) of the gutter bracket (10). In some embodiments, the lip (18) is not parallel with the intermediate portion (14). The second flange (17) then extends obliquely away from the intermediate portion (14) in front of the first flange (16). FIG. 1 further shows the second flange (17) as extending substantially parallel with the first flange (16). In some embodiments, the second flange (17) is not parallel with the first flange (16). First and second flanges (16, 17) of the gutter bracket (10) thereby form a recess (19). As such, first and second flanges (16, 17) of the gutter bracket (10) in FIG. 1 comprise a Z-shape configuration with each flange (16, 17) extending outwardly and upwardly from intermediate portion (14) and lip (18) extending rearwardly from flange (16). Of course, other suitable angles and configurations for the gutter bracket (10) will be apparent to one with ordinary skill in the art in view of the teachings herein. In some embodiments, flanges (16, 17) can include other shapes, such as an S-shape, a C-shape, an L-shape, or any other type of configuration that extends upwardly or outwardly to couple with the front (56) of a gutter (50) to support the gutter (50).

The first and second flanges (16, 17) of the gutter bracket (10) are couplable with the front (56) of the gutter (50). In some embodiments, the front (56) of the gutter (50) comprises a first protrusion (57) that forms a cavity to receive the second flange (17) of the gutter bracket (10). The front (56) of the gutter (50) further comprises a second protrusion (58) that forms a cavity configured to receive the first flange (16) of the gutter bracket (10). As shown in FIG. 1, the second protrusion (58) of the gutter (50) extends along the lip (18) of the first flange (16) of the gutter bracket (10) and comprises an overhang (55) that wraps around the lip (18) of the gutter bracket (10). The first and second protrusions (57, 58) of the gutter (50) form a recess (59). The recess (59) engages the recess (19) of the gutter bracket (10) such that the recess (19) of the gutter bracket (10) is configured to receive the recess (59) of the gutter (50).

When gutter bracket (10) is coupled with gutter (50), the weight of the gutter (50) is distributed on the gutter bracket (10) to prevent the gutter (50) from bending or slipping off of the gutter bracket (10). The first flange (16) of the gutter bracket (10) is inserted within the second cavity (58) of the gutter (50) such that lip (18) of the first flange (16) supports the second protrusion (58) and the overhang (55). The first flange (16) further supports a wall forming recess (59) of the gutter (50). The second flange (17) of the gutter bracket (10) engages the first cavity (57) of the gutter (50) to support the first cavity (57) and the opposing wall forming recess (59) of the gutter (50).

In some embodiments, the gutter bracket (10) is made of metal, vinyl, or other suitable materials able to reinforce the gutter (50). The gutter (50) can be made of 15" heavy duty aluminum, steel, or copper. A seamless gutter machine may be used to manufacture the gutter (50). The gutter bracket (10) may slide into the gutter (50) from the side to insert the flanges (16, 17) into the cavities (57, 58) of the gutter (50). In other embodiments, the front (56) of the gutter (50) may be flexible enough to flex slightly outwardly to snap fit over the flanges (16, 17) of the gutter bracket (10). Other methods for coupling the gutter bracket (10) with the gutter (50) will be apparent to one with ordinary skill in the art in view of the teachings herein.

The gutter bracket (10) is inserted within the gutter (50) such that the second flange (17) of the gutter bracket (10) engages the first cavity (57) of the gutter (10), the recess (19) of the gutter bracket (10) engages the recess (59) of the gutter (50), and the first flange (16) engages the second cavity (58) of the gutter (50). With the gutter bracket (10) engaged with the gutter (50), the gutter bracket (10) is able to reinforce the gutter (50) to prevent the front (56) of the gutter (50) from bending, sagging, or slipping when the trough (53) of the gutter (50) is filled with ice, snow, or other debris. Accordingly, each of the first flange (16), the second flange (17), and the recess (19) of the gutter bracket (10) reinforce the gutter (50) such that each flange (16, 17) and recess (19) supports the gutter (50) to distribute the weight of the gutter (50).

In some embodiments, the gutter bracket (10) has a width that is less than the length of the gutter (50) such that one or more gutter brackets (10) can be inserted within a gutter (50) to reinforce the gutter (50) at selective portions along the gutter (50). In some embodiments, the gutter bracket (10) has a width of between about ¼ inches and about 2 inches. In some embodiments, the width of the gutter bracket (10) may be substantially the same length as the gutter (50) to provide reinforcement along the entire length of the gutter (50). Alternatively or additionally, the first flange (16) and/or the second flange (17) of the gutter bracket (10) may have the same width as the gutter bracket (10) or the first flange (16) and/or the second flange (17) of the gutter bracket (10) may have a smaller width as the gutter bracket (10). Other configurations for the gutter bracket (10) will be apparent to one with ordinary skill in the art in view of the teachings herein.

Figure 2:
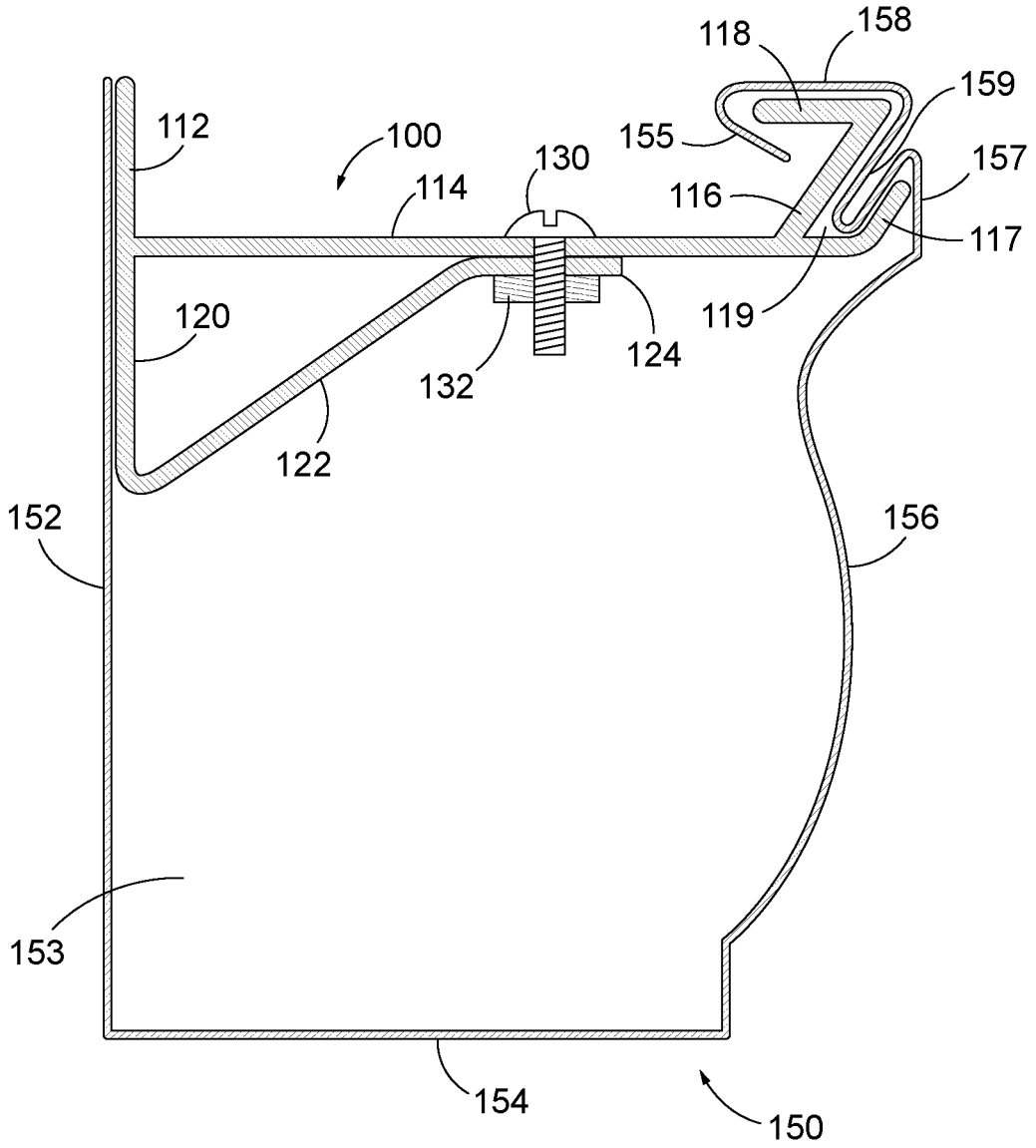
FIG. 2 is a side view of an alternative embodiment of a bracket assembled with a gutter.

FIG. 2 shows an alternative embodiment of a gutter bracket (100) that is similar to the gutter bracket (10) described above, except that this gutter bracket (100) comprises a support member (122). The support member (122) comprises a back member (120) that is aligned with and extends underneath the back portion (112) of the gutter bracket (100) along the back (152) of the gutter (150). The support member (122) then extends upward toward the front (156) of the gutter (150). The support member (122) comprises a coupling member (124) extending frontwardly adjacent to the intermediate portion (114) of the gutter bracket (100). The coupling member (124) of the support member (122) is attached to the intermediate portion (114). In the present embodiment, the coupling member (124) is attached to the intermediate portion (114) with a screw (130) extending through the coupling member (124) and the intermediate portion (114). A nut (132) is then coupled with the screw (130) to secure the coupling member (124) with the intermediate portion (114). Other suitable methods for securing the support member (122) with the intermediate portion (114) of the gutter bracket (100) will be apparent to one with ordinary skill in the art in view of the teachings herein. For instance, a nail, a bolt, a zip screw, adhesive, or other suitable types of fasteners could be used.

Figure 3:
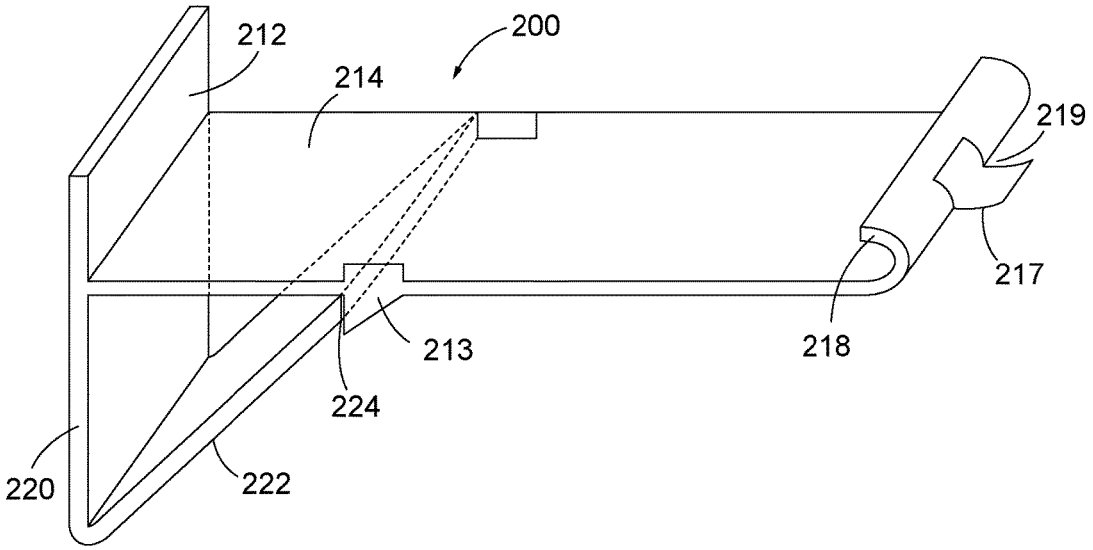
FIG. 3 is a top perspective view of an alternative embodiment of a bracket.

FIG. 3 shows another alternative embodiment of a gutter bracket (200) that is similar to the gutter bracket (10) described above, except that this gutter bracket (200) comprises a support member (222) and a C-shaped flange (218) that curves upwardly and rearwardly toward a back portion (212) of the gutter bracket (200). The support member (222) comprises a back member (220) that is aligned with and extends underneath the back portion (212) of the gutter bracket (200). The support member (222) then extends upward toward the front of the gutter bracket (200). The intermediate portion (214) of the gutter bracket (200) comprises a protrusion (213) extending downwardly that is configured to abut the end (224) of the support member (222). This prevents the support member (222) from moving relative to the intermediate portion (214) of the gutter bracket (200). Other suitable methods for preventing the movement of the support member (222) relative to the intermediate portion (214) of the gutter bracket (200) will be apparent to one with ordinary skill in the art in view of the teachings herein. For instance, a screw, a nail, a bolt, adhesive, or other suitable types of fasteners could be used.

The front portion of the gutter bracket (200) comprises a first flange (218) that curves upwardly toward the back portion (212) of the gutter bracket (200). The gutter bracket (200) further comprises a second flange (217) that extends outwardly from the first flange (218) to form a recess (219) between the first and second flanges (218, 217). The first flange (218) is wider than then second flange (217). Accordingly, the first flange (218) can be inserted into a corresponding second cavity of a gutter, the second flange (217) can be inserted into a corresponding first cavity of a gutter, and the recess (219) can receive a corresponding recess of a gutter to reinforce the gutter. While the present embodiment shows the second flange (217) having a smaller width and positioned centrally along the first flange (218), the second flange (217) can be the same width or wider than the first flange (218) and/or the second flange (217) can be positioned off-center from the first flange (218). Other suitable configurations for the gutter bracket (200) will be apparent to one with ordinary skill in the art in view of the teachings herein.

In some embodiments, the gutter bracket (10, 100, 200) is bowed along its length, or the gutter bracket (10, 100, 200) includes ridges along its length. This may strengthen the gutter bracket (10, 100, 200) along its length to reduce bending or torqueing of the gutter bracket (10, 100, 200).

While the present disclosure has illustrated by description several embodiments and while the illustrative embodiments have been described in considerable detail, it is not the intention of the applicant to restrict or in any way limit the scope of the appended claims to such detail. Additional advantages and modifications may readily appear to those skilled in the art.

What is claimed is:

1. A gutter bracket assembly comprising:

(a) a gutter bracket comprising:

(i) a back portin;

(ii) an intermediate portion extending substantially horizontally and frontwardly from the back portion;

(iii) a first flange extending outwardly from the intermediate portion; and (iv) a second flange extending outwardly from an outer edge of the intermediate portion;

wherein between the first and second flange is a rearward, down-sloping channel; and (b) a gutter constructed from a single piece of material comprising:

(i) a back coupled with the back portion of the gutter bracket;

(ii) a bottom extending frontwardly from the back; and (iii) a front extending upwardly from the bottom, wherein the front comprises a first protrusion and a second protrusion, which form a first and a second cavity;

wherein between the first and second protrusion the gutter forms a rearward, down-sloping tab; and wherein the first flange of the gutter bracket engages the second cavity of the gutter; wherein the second flange of the gutter bracket engages the first cavity of the gutter; and wherein the tab fits into the channel, wherein the first flange is closer to the back portion than the second flange wherein the first flange comprises a lip extending toward the back portion of the gutter bracket, and wherein the second protrusion comprises an overhang configured to wrap around the lip.

2. The gutter bracket assembly of claim 1, wherein the first and second flanges of the gutter bracket comprises a Z-shape configuration.

3. The gutter bracket assembly of claim 1, wherein the first flange comprises a carved profile to form a C-shaped configuration.

4. The gutter bracket assembly of claim 1, further comprising a support member extending from the back portion to the intermediate portion of the gutter bracket.

5. A method for reinforcing a gutter with a gutter bracket, wherein the gutter bracket comprises a back portion, an intermediate portion extending substantially horizontally and frontwardly from the back portion, a first Range extending outwardly from the intermediate portion, and a second flange extending outwardly from an outer edge of the intermediate portion; wherein between the first and second flange is a rearward, down-sloping channel;

wherein the gutter, constructed from a single piece of material, comprises a back, a bottom extending frontward from the back, and a front extending upwardly from the bottom, wherein the front comprises a first protrusion and a second protrusion, which form a first and a second cavity; wherein between the first and second protrusion the gutter forms a rearward, down-sloping tab, wherein the first flange is closer to the hack portion than the second flange wherein the first flange comprises a lip extending toward the back portion of the gutter bracket, and wherein the second protrusion comprises an overhang configured to wrap around the lip;

the method comprising the steps of (a) inserting the gutter bracket within the gutter such that the first flange of the gutter bracket engages the second cavity of the gutter, the second flange of the gutter bracket engages the first cavity of the gutter, and wherein the tab fits into the channel; and (b) coupling the back portion of the gutter bracket to the back of the gutter.

* * * * *